United States Patent [19]

Theodore

[11] Patent Number: 4,508,508

[45] Date of Patent: Apr. 2, 1985

[54] FIREARM TRAINING SYSTEM

[76] Inventor: Paris Theodore, 115 E. 62nd St., New York, N.Y. 10021

[21] Appl. No.: 535,416

[22] Filed: Sep. 26, 1983

[51] Int. Cl.[3] ..... F41G 3/26; F41J 1/00

[52] U.S. Cl. ..... 434/19; 273/409

[58] Field of Search ..... 434/16, 19, 406, 267, 434/269, 272, 368, 370, 395, 396, 398, 347; 273/348, 409, 410

[56] References Cited

U.S. PATENT DOCUMENTS

| | | | |
|---|---|---|---|
| 1,223,290 | 4/1917 | Ravenshear | 273/409 |
| 1,635,734 | 7/1927 | Ziegler | 434/347 |
| 2,090,930 | 8/1937 | Chubb | 273/408 |
| 4,203,600 | 5/1980 | Brown | 273/409 X |

*Primary Examiner*—William H. Grieb

*Attorney, Agent, or Firm*—Hedman, Gibson, Costigan & Hoare

[57] ABSTRACT

A novel firearms target is described which is useful in training police officers and others in the use of small arms.

9 Claims, 6 Drawing Figures

FIREARM TRAINING SYSTEM

BACKGROUND OF THE INVENTION

Conventional approaches to firearms training have been based on the use of targets that have indicia placed on the surface that is presented to the shooter. These targets have been utilized in point shoulder shooting, two handed slow and rapid fire or in quick-draw, shooting from the hip practice drills as well as in combat hand gun training and matches. Generally all of the silhouette type targets have been provided with indicia that directs the attention of the shooter to the chest cavity in order to cause the shooter to aim for the heart of the figure depicted on the target. These targets have been full front views in the case of human silhouettes and full side views in the case of large animal targets.

The prior firearms training systems have failed to adequately simulate conditions that are encountered by police officers and others who must use firearms in self defense or for other purposes. The deficiency of these systems lies primarily in a failure to simulate the target that will actually be presented to the shooter and in failing to instruct the shooter what zones of the anatomy should be targeted in order to disable the human or animal subject.

A bullet that enters the chest cavity and damages the heart or lungs will usually cause death within a short time. However, these type of wounds do not necessarily prevent the wounded individual from being able to squeeze the trigger of a handgun while continuing to be a lethal threat to his victim. Heart or lung shots are believed to be a throwback to the hunters technique of preserving the trophy-head by shooting at a vital zone that would result in killing the animal without leaving a mark on the trophy-head. These shots are not rapidly effective when a handgun caliber is used. Usually, it is necessary to use a hunting rifle caliber to obtain rapid or instantaneous disablement of the targeted subject by wound cavitation and trauma. Combat handgun calibers cannot deliver sufficient foot-pounds of energy on target to rapidly disable a targeted subject. Prior art combat silhouette targets assign the highest possible score to the heart and lung shots. It is believed that one of the prime reasons for the failure of the so called "heart-lung" shots to immediately disable the subject is that when bullets strike body tissues there is no immediate pain response that causes the subject to lose control over his voluntary muscles. Almost invariably there is never any immediate pain or drastic fall in blood pressure that occurs when a targeted subject or armed assailant is hit with a bullet in the area of the heart or lungs. This physiological phenomenon allows such an assailant to function in a potentially lethal manner. This is due to the failure of handgun projectiles to generate sufficient hydrostasis or foot-pounds of energy to sufficiently damage vital organs to immediately disable a targeted subject.

Accordingly, it is a primary object of this invention to provide an improved firearm training system and target that more closely simulates conditions that are likely to be encountered with human or animal subjects.

It is also an object of this invention to provide a method for training the shooter to aim for those areas of the anatomy that will result in the instantaneous disability of a human or animal subject.

DETAILED DESCRIPTION OF THE INVENTION

The invention includes a target for firearms training which comprises a planar sheet material having on one surface indicia that represents a targeted subject and on the reverse surface, indicia that corresponds to the human or animal zone that is coextensive with the area which extends longitudinally from the lower portion of the cranial cavity to the base of the spine and laterally to both sides of the spinal column and to the area surrounding the kidneys of said targeted subject which appears on said forward surface.

The planar sheet material may be made in any shape that will accomodate the figure of a targeted subject. Only the figure of the targeted subject will appear on the forward surface of the target. The targeted subject may be presented in various frontal, partial frontal, side or rear view from an elevated, level or downward perspective. The use of various perspective views is intended to be used in training the shooter to aim for the anatomical zone that is most sensitive to the impact of a bullet.

Figure 2:
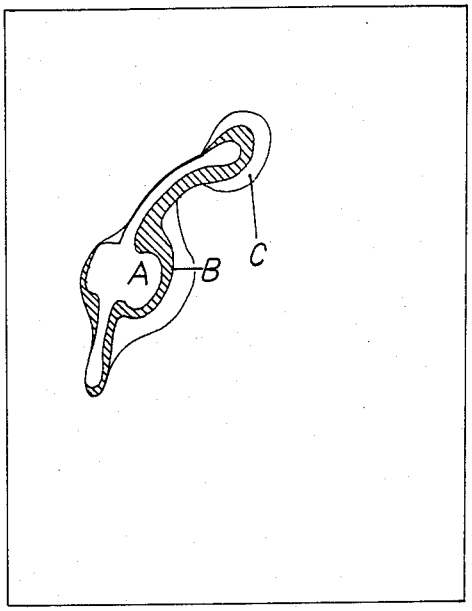
FIG. 2 is a view of the target of FIG. 1 which shows the reverse side of FIG. 1 on which appears an outline of the zones that represent the areas to be targeted on FIG. 1

The anatomical zone that is depicted in the drawings has been designated by the inventor as the "quell zone". It begins at the lower portion of the cranial cavity where the medula oblongata is found adjacent to the cerebrum. It extends downward along the spine to the cauda equina and outwardly to the region of the kidneys. The central zone A of FIG. 2 shows the core of the Quell zone which is most susceptible to the impact of a bullet. This zone may be affected by a bullet that strikes the subject from the front, side or rear. Adjacent to the central zone A is secondary zone B which abuts the spinal column and kidney area per se. The secondary zone B, will exhibit a lesser response to a small caliber bullet, e.g. 0.38 caliber than central zone A. The hydrostatic effect of a bullet on secondary zone B, will depend on the caliber of the bullet and its speed which determines the foot-pounds of energy imparted. Tertiary zone C is shown in FIG. 2 as extending principally along one side of secondary zone B. It should be understood that the tertiary zone C will only be accessible when the target is viewed laterally or in a partial lateral view. This is because the tertiary zone is obscured by other tissues that might protect the target from being immediately disabled. By reference to FIG. 2, the extent of zone may be readily comprehended.

The targeted subject matter may be a human for use in training police officers, bodyguards, military and para-military personnel to maximize the effective use of handguns for their own personal safety and the safety of others.

Game animals may be placed on the targets of the invention with corresponding "quell zones" depicted on the reverse side. The game animals include deer, bears, racoons, boars, wildcats and the like.

The use of a target with no scoring rings on the facing side, but with indicia on the reverse side that shows the predicted effectiveness of a particular practice shot is intended to train the shooter to instinctively aim for the "quell zone". The development of the instructive targeting of the "quell zone" without any directing indicia on the face or forward side of the target will closely approximate real life combat shooting conditions. These targets may be utilized at practice ranges where they are mounted as are standard pistol combat targets either on standard target frames or with clips on an overhead pulley system that is used for stationary target practice. They may also be mounted on "pop-up" targets that are suddenly presented on a practice range in training the shooter to discriminate between threatening and non-threatening situations.

Targeted subjects do not wear "bull-eyes" on their outer garments, yet combat range instructors teach that one shoots to register "hits" according to the position of these scoring rings on silhouette targets, with no thought given to what "hits" in this area would actually do to a live opponent. Wadcutter bullets are used to more clearly delineate "hits"; wadcutters punch perfectly round holes in paper and together with the bulls-eye silhouette targets, reinforce the practice of "walking-shots-on-target"; i.e., adjusting the impact of each shot relative to the preceding "hit". This practice cannot happen in life, as bullet holes (in flesh) tend to be self sealing. In a real-life combat situation, there are almost never any reliable or accurate visual cues relative to the degree of severity of "hits" to the body.

DESCRIPTION OF THE PREFERRED EMBODIMENTS

Figure 1:
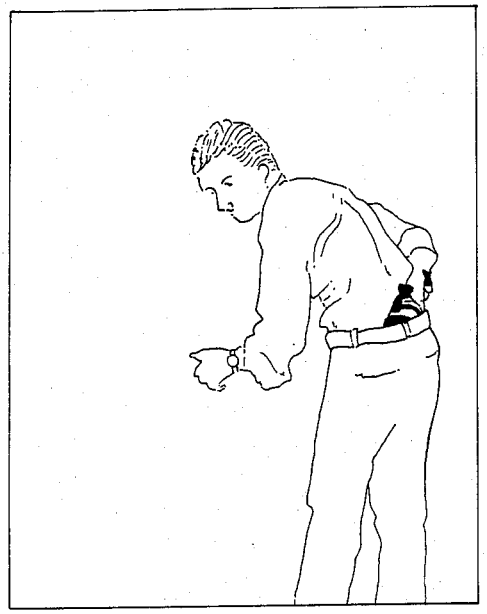
FIG. 1 is a front view of a combat picture target which shows a three quarter dorsal view that has on the reverse side an outline of the zones that represent the targeted areas.

FIG. 1 shows the front of a target according to the invention. The targeted subject is shown in a three-quarter side view in the act of drawing a hand-gun while the eyes are looking in the direction of the shooter. This view is an illustration of a view that may be presented to a police officer when he is engaged in apprehending a criminal. The target may be made of paper, plastic or wood which is sufficiently stiff to present a substantially flat surface when the target is affixed to appropriate mounting means (not shown).

The trainee is instructed to aim at zone A, which is not shown on the face of the target, prior to actually shooting. After the practice shots have been taken, the target is retrieved for inspection and evaluation of the accuracy of the shooter's practice shots. If desired the target may be axially mounted on a remotely operated revolving mount that may be rotated for evaluation of the accuracy of the shots without retrieval of the target.

It is contemplated that the target may be made with a targeted subject in any number of positions with the respective quell zones shown on the reverse side. The use of realistic life-size color or black and white targets is also within the scope of the invention.

Figure 3:
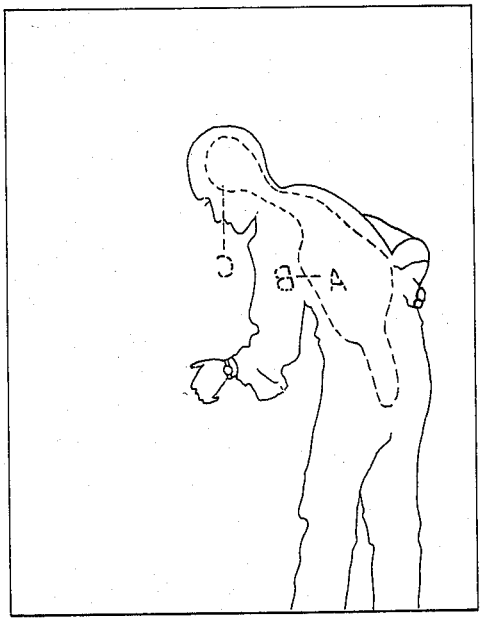
FIG. 3 is a schematic frontal view of the target of FIG. 1 on which is shown by dotted lines the outline of the zones that represent the targeted areas.
Figure 5:
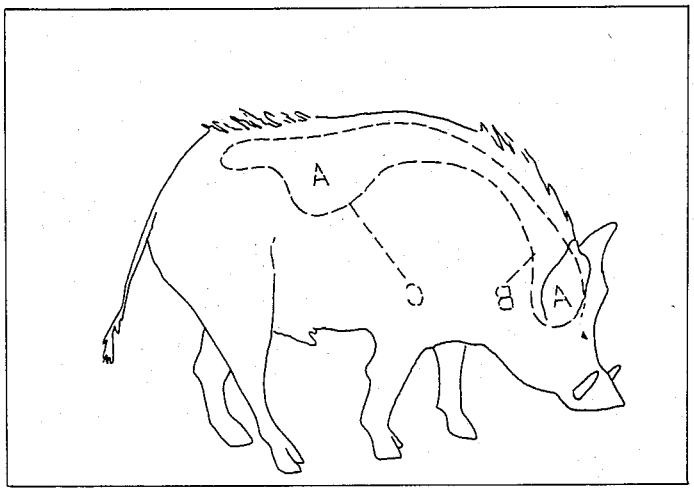
FIG. 5 is a schematic frontal view of the target of FIG. 1 on which is shown by dotted lines the outline of the zones that represent the targeted areas.

FIG. 3 and FIG. 5 show the targeted zones with letters A, B and C as mirror images to accurately reflect the view of the target if it was placed on a transparent planar sheet.

Figure 4:
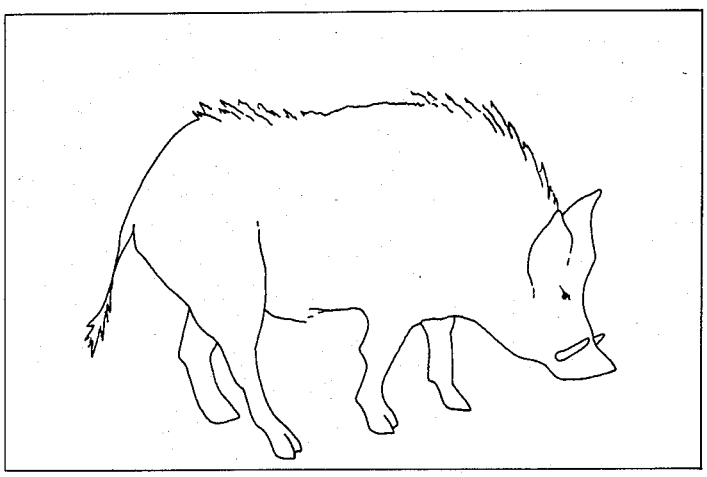
FIG. 4 is a front view of a hunting target which shows a lateral view of a boar.
Figure 6:
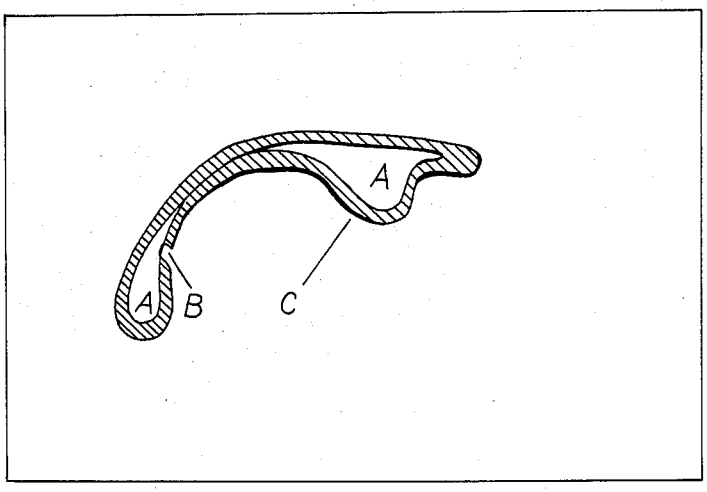
FIG. 6 is a view of the target of FIG. 4 which shows the reverse side of FIG. 1 on which appears an outline of the zones that represent the areas to be targeted on FIG. 1.

FIG. 4 and FIG. 6 show the front and rear views of a target that may be used for training hunters to aim for the quell zone when shooting wild boars in the field. It should be noted that targets depicting other animals may also be made according to the teachings of the present application.

Obviously, other modifications or variations of the present invention are possible in the light of the above teachings. It is, therefore, to be understood that changes may be made in the particular embodiments of the invention described which are within the full intended scope of the invention as defined by the appended claims.

I claim:

1. A target for firearms training which comprises:

a planar sheet material having on the forward surface indicia that represents a targeted subject and on the reverse surface indicia that corresponds to the human or animal anatomical zone that is coextensive with the area which extends longitudinally from the cranial cavity to the base of the spine and laterally to both sides of the spinal column and to the area surrounding the kidneys of said targeted subject which appears on said forward surface.

2. A target for firearms training as defined in claim 1 wherein the indicia of the targeted subject is a frontal view of a human.

3. A target for firearms training as defined in claim 1 wherein the indicia of the targeted subject is a side view of a human.

4. A target for firearms training as defined in claim 1 wherein the indicia of the targeted subject is a partial rear view of a human.

5. A target for firearms training as defined in claim 1 wherein the indicia of the targeted subject is a side view of a big game animal.

6. A method of instructing a shooter in the use of firearms which comprises presenting said shooter with a target that comprises a planar sheet material having on the forward surface indicia that represents a targeted subject and on the reverse surface indicia that corresponds to the human or animal anatomical zone that is coextensive with the area which extends longitudinally from the lower portion of the cranial cavity to the base of the spine and laterally to both sides of the spinal column and to the area surrounding the kidneys of said targeted subject which appears on the forward surface.

7. A target for firearms training which comprises a planar sheet material having on the forward surface, indicia that represents a targeted three-quarter side view of a subject and on the reverse surface indicia which consists of a zone corresponds to the human or animal anatomical zone that is coextensive with the area which extends longitudinally from the cranial cavity to the base of the spine and laterally to both sides of the spinal column and to the area surrounding the kidneys of said targeted subject which appears on said forward surface.

8. A target as defined in claim 7 wherein the targeted subject is a human.

9. A target as defined in claim 7 wherein the targeted subject is an animal.

* * * * *